US006585085B1

(12) United States Patent
Kumar

(10) Patent No.: US 6,585,085 B1
(45) Date of Patent: Jul. 1, 2003

(54) WAYSIDE WHEEL LUBRICATOR

(75) Inventor: Sudhir Kumar, Darien, IL (US)

(73) Assignee: Tranergy Corporation, Bensenville, IL (US)

( * ) Notice: Subject to any disclaimer, the term of this patent is extended or adjusted under 35 U.S.C. 154(b) by 0 days.

(21) Appl. No.: 09/583,308

(22) Filed: May 30, 2000

(51) Int. Cl.[7] ..... B61K 3/00
(52) U.S. Cl. ..... 184/3.2
(58) Field of Search ..... 184/3.1, 3.2, 12, 184/15.1

(56) References Cited

U.S. PATENT DOCUMENTS

| | | | | | |
|---|---|---|---|---|---|
| 1,923,449 | A | * | 8/1933 | Merk | 184/3.1 |
| 2,028,517 | A | * | 1/1936 | Moore et al. | 184/3.1 |
| 2,272,775 | A | * | 2/1942 | McGarry | 184/3.1 |
| 3,599,752 | A | * | 8/1971 | Bowler et al. | 184/3.2 |
| 3,635,310 | A | * | 1/1972 | Roll | 184/3.2 |
| 3,838,646 | A | * | 10/1974 | Smith et al. | 184/3.2 |
| 4,101,002 | A | * | 7/1978 | Almasy | 184/3.2 |
| 4,214,647 | A | * | 7/1980 | Lutts | 184/3.1 |
| 4,334,596 | A | * | 6/1982 | Lounsberry, Jr. | 184/3.1 |
| 4,520,901 | A | * | 6/1985 | Borup et al. | 184/3.1 |
| 4,648,486 | A | * | 3/1987 | Kayser et al. | 184/15.1 |
| 4,711,320 | A | | 12/1987 | Dombroski et al. | 184/3.2 |
| 4,726,448 | A | | 2/1988 | Schroeder et al. | 184/3.2 |
| 4,763,759 | A | | 8/1988 | Federico | 184/3.2 |
| 4,856,617 | A | * | 8/1989 | Lounsberry, Jr. | 184/3.1 |
| 5,119,989 | A | | 6/1992 | Kamis | 239/8 |
| 5,477,941 | A | * | 12/1995 | Kumar et al. | 184/3.2 |
| 5,722,509 | A | * | 3/1998 | Clinger | 184/3.1 |
| 6,076,637 | A | * | 6/2000 | Kumar | 184/3.2 |

* cited by examiner

*Primary Examiner*—Chong H. Kim
(74) *Attorney, Agent, or Firm*—Cook, Alex, McFarron, Manzo, Cummings & Mehler, Ltd.

(57) ABSTRACT

A wayside lubricator for railroad cars has a number of sensors mounted adjacent the track which detect the approach and passage rail cars. A lubricant supply and a pressurizing system are mounted adjacent the track and in fluid communication with a control valve and spray nozzle. The spray nozzle is aimed to shoot lubricant into a target zone when the control valve is opened. The spray nozzle is turned on for a defined duration of time so that the quantity of the lubricant is kept under control. Application of the lubricant to the wheels of the locomotive is avoided by detecting locomotive wheels and leaving the valve closed until they pass. This invention reduces the friction between the wheel tread and rail on curves for the trailing cars and thus reduces the friction and the force that is experienced by the wheel flanges on curves.

13 Claims, 7 Drawing Sheets

WAYSIDE WHEEL LUBRICATOR

BACKGROUND OF THE INVENTION

Wayside rail lubrication has been used in the railroad industry primarily to reduce the wear of wheel and rail on curves. The most common devices used for such lubrication are wayside rail lubricator strips. These strips are parallel to the rail and dispense grease before and during the passage of a wheel allowing the wheel flange to pick up the grease and lubricate the gage side of one or both rails. Most of these lubricators are designed to avoid lubricating the top of the rail so that the wheel treads are not affected by the lubricant applied by the wayside lubricator. The situation is slightly different in railroad hump yards. In these yards, it is currently common practice to apply grease to the top of the rail either manually or using a greasing system that dispenses grease through a hole in the rail so that the rolling resistance of the cars is reduced and the rollability is improved. There are several problems with both the wayside grease lubricators and the grease plugs used in the yards. These include the mess created by the black grease which coats the rails, the ties, ballast and the area where the wayside lubricator or the grease plugs are installed. Often the grease spreads, and coats such a large area that it is a slipping hazard to ground personnel. Wayside rail lubricators are difficult to maintain and adversely affected by temperature and weather changes. In yards, the grease plug lubricators do not consistently improve the rollability of cars. The hole in the rail often results in a broken rail which has to be replaced with a similar rail with a hole. Many cars do not clear the curves in the yard as they are supposed to—they have to be pushed into position (trimmed) by a locomotive. The skids, used to stop the rollout of the cars beyond safe points, fail to stop the cars because of excessive grease on the rails. The skids themselves slide for long distances creating situations where the car rollout can result in impact with another car. At times, the grease has contaminated the retarders which are supposed to slow down the cars to a defined speed. Such contamination can result in a loss of control for the retarders.

Lubrication with grease has traditionally been used on the wayside of rail curves as well as on curves in the different yards. As mentioned earlier, the current practice is to use wayside grease lubricators which consist of long grease application bars through which the grease is pumped in a certain quantity so that when the train approaches and crosses the curve, this grease is picked up by the flanges of all wheels including the locomotives and cars. In the railroad marshaling and hump yards, the lubrication of the rail is done either manually or through a device commonly called a 'grease plug'. These are through holes in the head of the rail through which grease is squeezed under pressure when a wheel passes over it. Both the wayside lubricators and the yard grease plug lubricators have serious problems. The new method proposed in this invention overcomes the problems encountered to date and improves both wayside lubrication and yard rail lubrication. The problems of wayside lubricators are discussed first.

The grease bars laid parallel to the rail traditionally apply large quantities of grease which are picked up by the wheels and flung all over the track. The grease spreads all over the rails, track, ties, ballast etc. developing a hazardous coating which makes it difficult and dangerous to service these lubricators. Over the years, these lubricators have been found difficult to maintain. Temperature and weather seriously affect their functioning. In order to make sure that some grease is applied to the rail gage corner, the common practice is to increase the quantity of grease in the lubrication bars. This is so large in many cases that it spreads all over the rail head as well. When the train approaches the curve with the grease spread over the rail head, the locomotive wheels slip. As a result, sand is automatically injected. This results in the development of a sand-grease grinding paste which defeats the purpose of rail lubrication and contaminates the ballast, ties, etc.

Looking at the railroad yards, the current practice of lubrication uses wayside lubrication devices such as grease plugs through a hole in the rail head. These also do not function well. Although a large quantity of grease is applied via this through hole in the rail head, it does not adequately lubricate the wheel-rail contact on sharp curves. Since the quantity of grease put through this hole is quite large, it spreads in a coating on the rail throughout the yard as well as builds up on the sides when spills take place. The coating on the rail head is enough to coat the skids placed on the rails to stop the cars from sliding on the rails. Thus, the skids do not stop the car and let it go into a rollout sometimes resulting in collision damage. In spite of such greasing, the rolling friction between all the wheel and rail contacts is not reduced enough and many cars do not go beyond the sharp curves and have to be pushed by a locomotive which has difficulty itself pushing because of locomotive wheel slip.

SUMMARY OF THE INVENTION

This invention solves the problems indicated above by applying a spray of clean, smoothly-flowing lubricant directly on the approaching car wheel. For revenue service trains, appropriate sensors detect the passage of the locomotive wheels and do not apply any lubricant. After the locomotive wheels have passed, the lubricant is sprayed by a nozzle on the wheels of the trailing cars. Such an application may be made to both wheels of a wheel-set or a single wheel. The wheel to which the lubricant is applied becomes a carrier and spreads it on the rail at the points of wheel-rail contact to benefit the trailing cars. For the railroad yards, the situation is simpler in that for all approaching cars, the wayside wheel lubricator puts out a spray to lubricate one or more wheels.

This system requires a number of sensors by the wayside which detect the approach and passage of the car or the train. It also requires a lubricant supply and a pressurizing system which develops pressure to move the lubricant from its reservoir to a spray nozzle. In addition, it requires that the spray nozzle can be turned on for a defined duration of time so that the quantity of the lubricant is kept under control. The number and frequency of applications can be calculated for the train or the cars in the yard. By avoiding application of the lubricant to the wheels of the locomotive, this invention reduces the friction between the wheel tread and rail on curves for the trailing cars only and thus reduces the friction and the force that is experienced by the wheel flanges on curves. This method is superior to the current wayside lubricator approach a in that it does not degrade the traction of the locomotive wheels and it reduces the friction as well as the lateral force produced by the car wheels on the rail. In other words, the force exerted by the wheel flanges on the rail is reduced. Current wayside lubricators are designed to reduce only the flange friction with the rail. Furthermore, it applies an accurate amount of lubricant in small quantities directly on the wheels so that the cleanliness of the rail bed is maintained. By using this approach, the rollability of cars in yards can be improved significantly (50% or more). A similar reduction in rail forces and rail-wheel wear on curves in revenue service is expected by using this method of wheel lubrication.

For good lubrication, it is necessary to lubricate much of the wheel tread and the flange that comes in contact with the rail head. The new method of the present invention achieves the needed characteristics and accomplishes the following:

- it reduces the friction between the car wheel tread and flange with the rail for all positions that the wheel can have on the rail in a curve including an "S" curve;
- it reduces the lateral force developed by the wheel on the rail;
- it is beneficial to reduce rail and wheel wear and also reduce the cost of maintenance of curves; and
- it does not negatively affect the adhesion of locomotive wheels on curves.

DETAILED DESCRIPTION OF THE INVENTION

Figure 1:
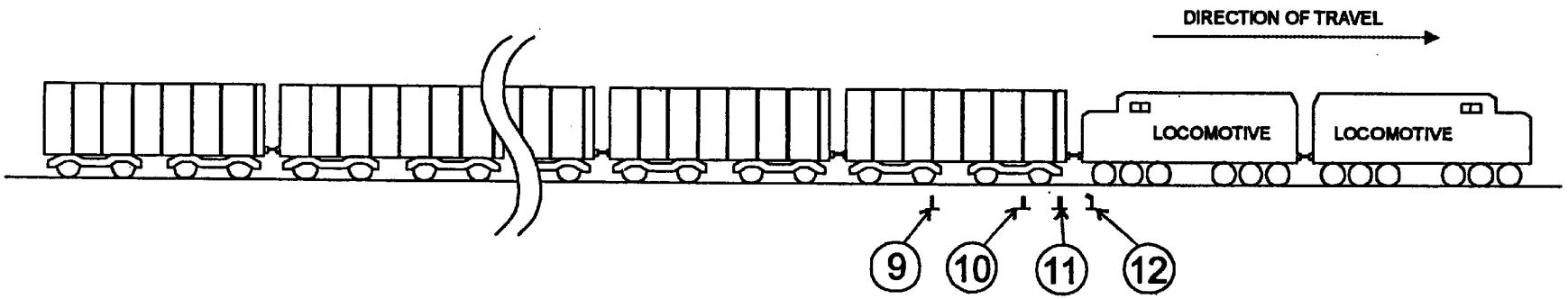
FIG. 1 is a schematic side elevation view of a train on a track equipped with the wayside lubricator of the present invention and its associated sensors.

The basic arrangement of a wayside wheel lubricator and how it functions is shown in FIG. 1. The figure shows the position of a train on a track in which the lubrication nozzle 12 is first turned on. There are a number of sensors placed by the wayside whose purpose is to first detect the approaching train and then to turn on the pressurizing system to develop the requisite pressure to apply the lubricant through a nozzle. The sensors detect the passage of the wheels of the train. There are a number of different sensors that can be used for this purpose. Rugged, weather-sealed light or laser beam sensors, which sense the passing wheel by the interruption of the beam, are one possible choice. Inductive type magnetic sensors which produce a signal when the steel wheel passes over them are another possibility. Any other sensors based on electric, acoustic or infrared phenomena may be used. The sensor determines the presence of the passing wheel and its complete passage.

Locomotive wheel passage is different from car wheel passage in the following respects:

1. Locomotive wheels are larger in diameter (40"+) than car wheels (33"–36").
2. Locomotive trucks are much longer than car trucks. Four axle locomotives have axle spacing greater than 108" whereas car wheel axle spacing is typically 70".
3. A significant percentage of locomotives have three axle trucks.
4. The three axle locomotive truck wheels are spread over a distance of 150".

The train approach sensor 9 detects the passage of the first wheel and turns on the lubricant pumping system. It also measures the duration of signal interrupts due to each wheel and between consecutive wheels. The second approach sensor 10 also detects the same signals as the first approach sensor 9. A microprocessor receiving both sensor signals compares the two signals. It calculates the speed of the train and determines whether the spacing of the wheels is much more than 70" and whether there are three wheels of larger diameter, passing consecutively. The larger diameter wheels have a larger intercept of the sensor signal. Light sensors can detect the wheel diameter more easily than others, and might be preferable for such determination of wheel diameters. With other sensors, the time interval between signals and calculated speed will enable distinguishing the locomotive truck from the car truck. When the locomotive wheels and truck are detected, the lubricant spray is not turned on. As soon as the car wheel is detected by sensors 9 and 10, sensor 11 is ready to turn on the lubricant spray through nozzle 12 when the car wheel approaches it. The spacing of sensors 9, 10, and 11 is only a schematic, and would be greater in revenue service and experimentally determined for a route depending on the maximum train speed, response time of the spray unit and the processing speed of the microprocessor.

It is preferable to use an environmentally clean friction modifier (FM) for lubrication although any lubricant that flows well under pressure and does not clog the nozzles would suffice. It is planned to use the hydraulic pulse width modulation technique developed earlier to determine the amount of FM to be applied by the nozzle in a single shot. That method is shown and described in U.S. patent application Ser. No. 09/046,195, filed Mar. 23, 1998, the disclosure of which is incorporated herein by reference. Depending on the speed of the train, if enough time is available for the car wheel from the sensor 11 to the nozzle 12, two or three shots of small amounts may be made on the same wheel tread and flange to spread it around the circumference of the wheel. This will enable better application of FM to the rail as the wheel rolls forward. A similar set of spray shots may be made on the lead wheel of the trailing truck. Depending upon the consumability of the FM, the sensors will then apply similar FM shots on the leading wheels of its two trucks of a car after a suitable number of cars (determined experimentally) have passed (e.g. 10). Application of the number of shots and the number of trucks and cars is a matter of design selection. As with other wayside lubricators, this lubrication system will be located at or near the entry of a curve in both directions.

Figure 2:
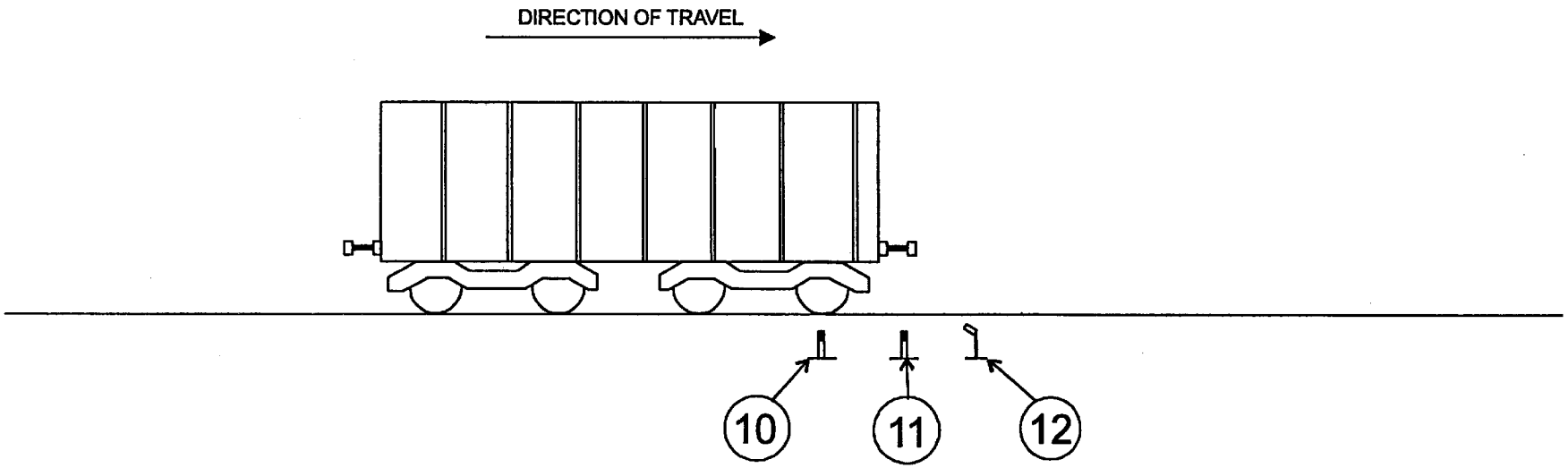
FIG. 2 is a schematic side elevation view of a single car approaching the sensors of the wayside lubricator of the present invention installed in a classification yard.

FIG. 2 shows an arrangement that might be used to apply the FM on the wheels of a car in a railroad yard. The location of the sensor 10 that detects the approach of the car may be either before or after the retarders used for a group of tracks. For a hump yard, it is located in the vicinity of the retarders in the lower part of the yard referred to as the 'bowl'. Thus, one wayside wheel lubricator will lubricate the cars with FM going into the tracks of the group being serviced by the single car retarder. The sensor 11 that triggers the spray from the nozzles and the nozzles themselves are located before the entry of the curve. In a classification, marshaling, or hump yard, the speeds of the cars exiting the retarders are in a fairly narrow range, typically around 10 mph. Therefore, one sensor for detecting the approach of the car is adequate. Also, lubrication of the wheels of every single car is not necessary. Every third, fourth, fifth or more car wheels may be lubricated depending on the sharpness of the curves and the length of the tracks of the yard.

Thus, as the car nears the location where a curve starts, a sensor 10 detects the approach of the car and a sensor 11 signals the control system to apply the lubricant through a nozzle spray from the applicator 12. In the yards, the logic of detection is simpler because locomotives are not involved. However, when a series of cars approaches the lubricator in a yard, FM may be applied to every third, fourth or fifth car.

Figure 3:
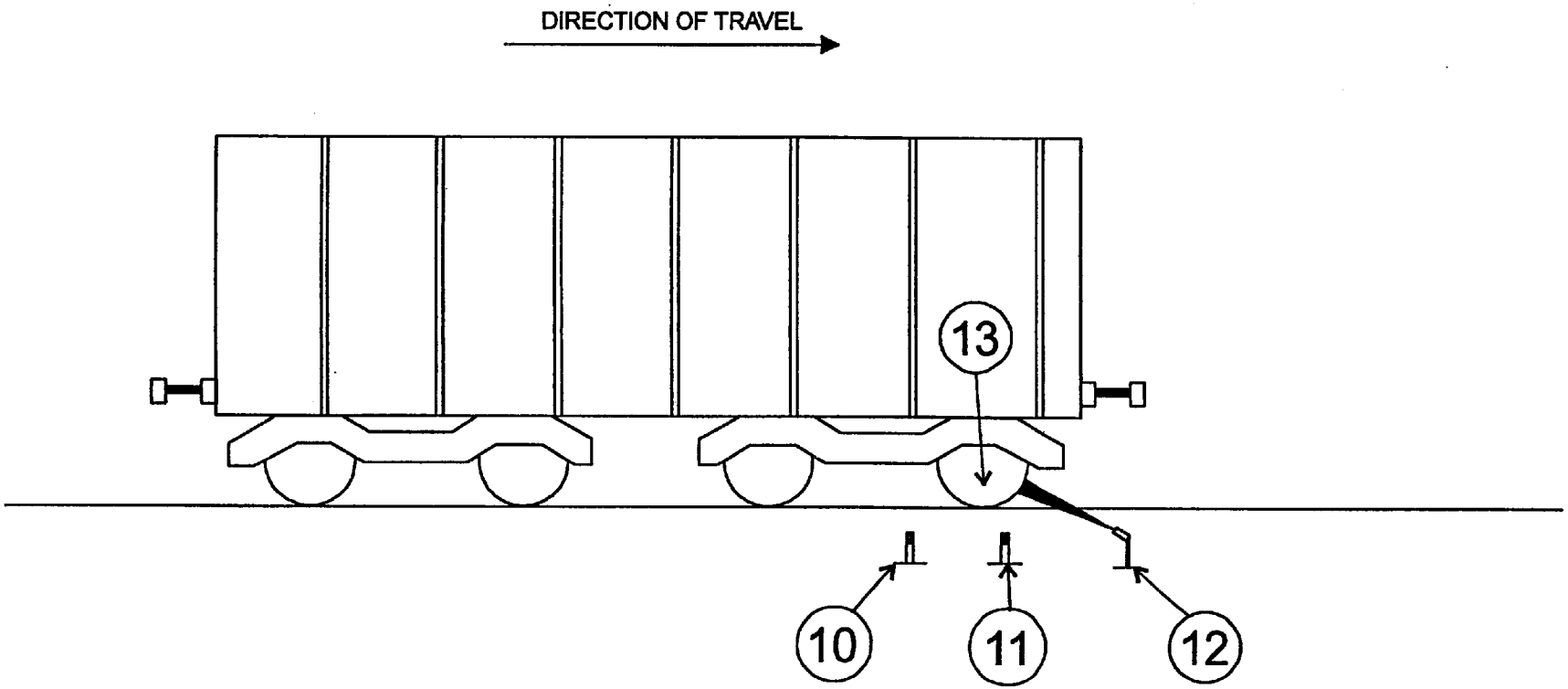
FIG. 3 is an enlarged view similar to FIG. 2, showing the lubricator activated to apply a controlled quantity of friction modifier to a car wheel.

FIG. 3 shows a car approach which triggers the wheel lubricator to fire a single or multiple shots of controlled quantity of the FM through nozzle 12 against a wheel 13. The nozzle is aimed to shoot the FM into a target zone. The microprocessor takes the information from the sensors regarding train speed together with the known response times of the hydraulic system and calculates when to activate the hydraulic system so that the FM will arrive in the target zone at the same time as the wheel arrives in the target zone.

Figure 4:
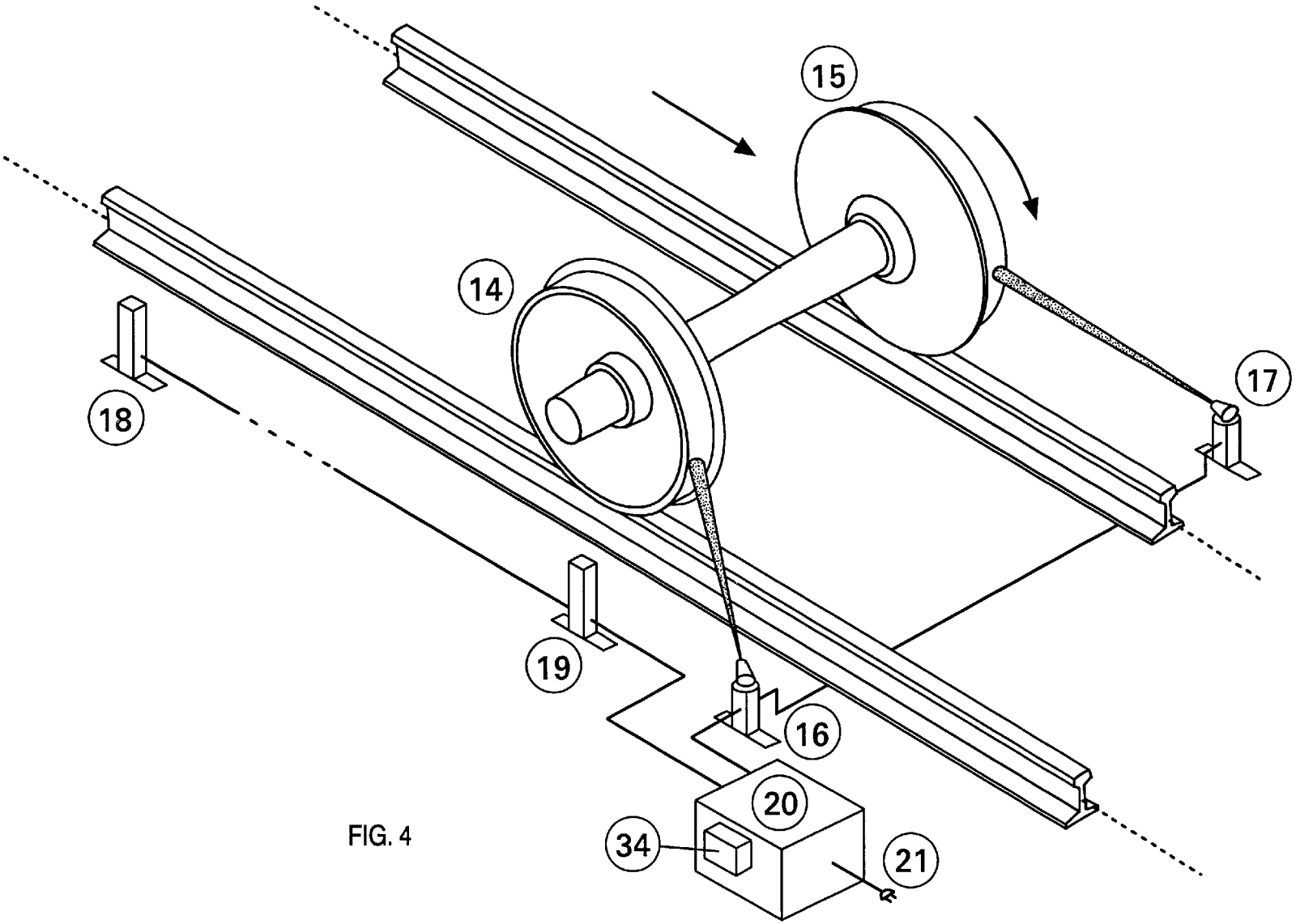
FIG. 4 is a schematic perspective view of the wayside lubricator.
Figure 6:
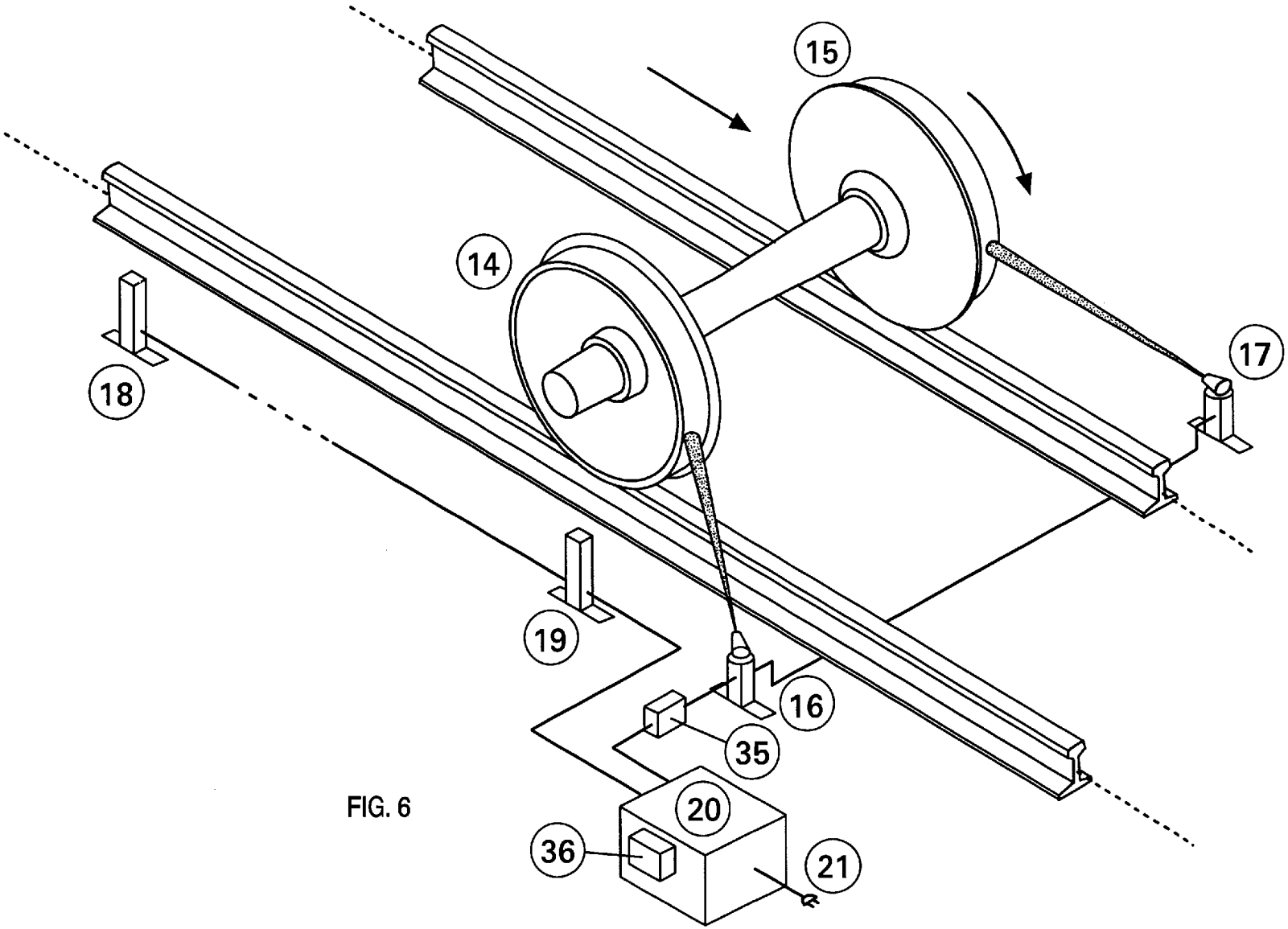
FIG. 6 is a schematic perspective view, similar to FIG. 4, showing a solenoid valve and an alternate form of pressurizing means.
Figure 7:
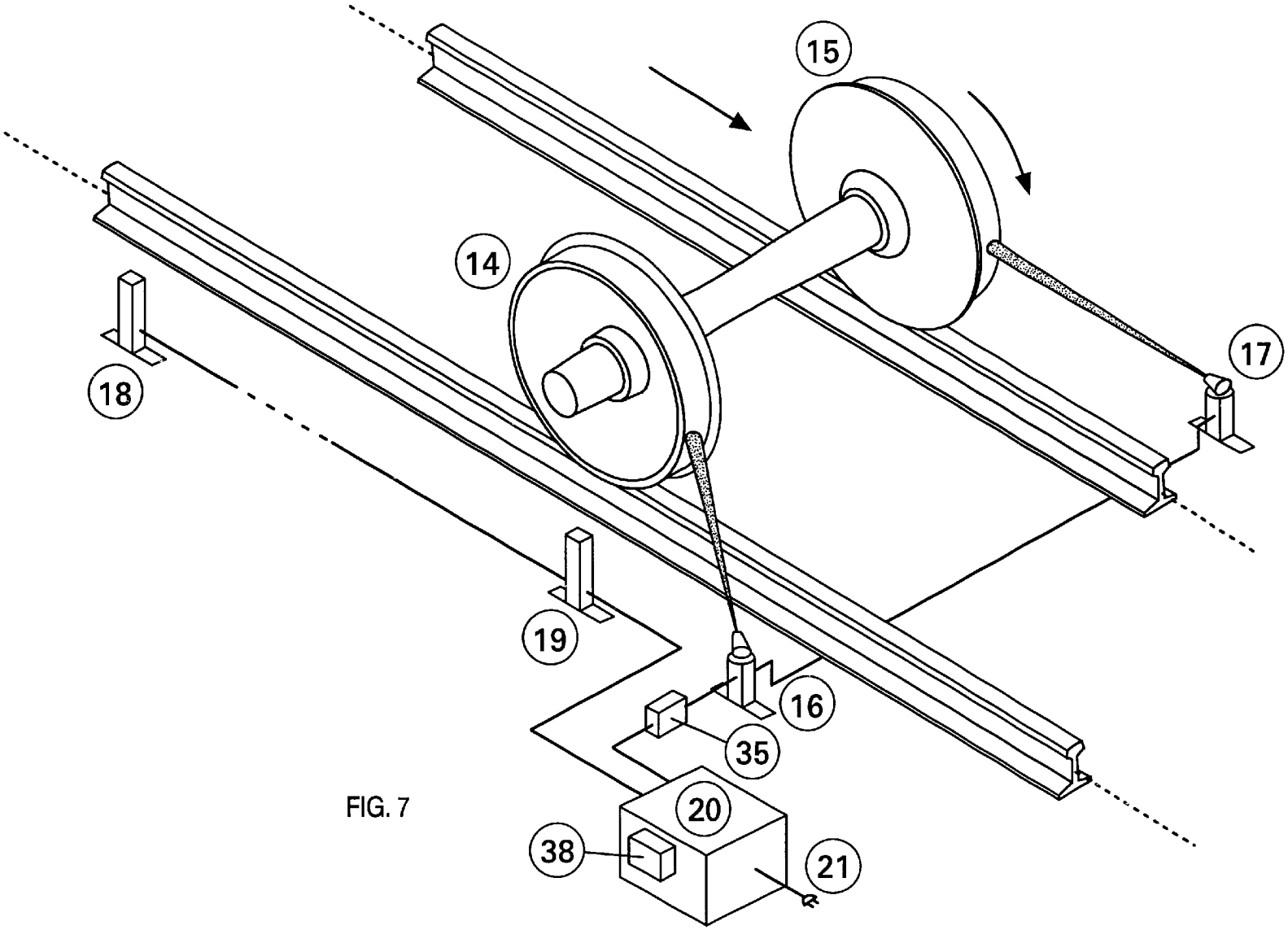
FIG. 7 is a schematic perspective view, similar to FIG. 4, showing a solenoid valve and an alternate form of pressurizing means.

FIG. 4 shows an arrangement of the wayside wheel lubricator showing the sensors 18 and 19 and application nozzles 16 and 17. Nozzle 16 is aimed at wheel 14 while nozzle 17 is aimed at wheel 15. The lubricant shot initially hits the wheel flange and tread and as the wheel comes closer to the spray nozzle, the lubricant shot hits the tread. The solenoid valve 35 (FIG. 6) controlling the lubricant delivery is close to the nozzle or orifice on each side of the rail. The nozzles are hydraulically connected with a line which is provided the pressure from a pressurizing system 34, FM reservoir and electronic control unit placed in the box 20. The pressurizing system could be a pump 36 (FIG. 6), air compressor 38 (FIG. 7) or other similar device. The electronic unit gets the signal from the sensors 18 to turn the system on and from sensor 19 to open the nozzle for a defined duration to apply the requisite amount of the FM on the wheel tread and flange. An electrical power supply is indicated schematically at 21. If no electrical power is available, a battery or solar cell could be used.

Figure 5:
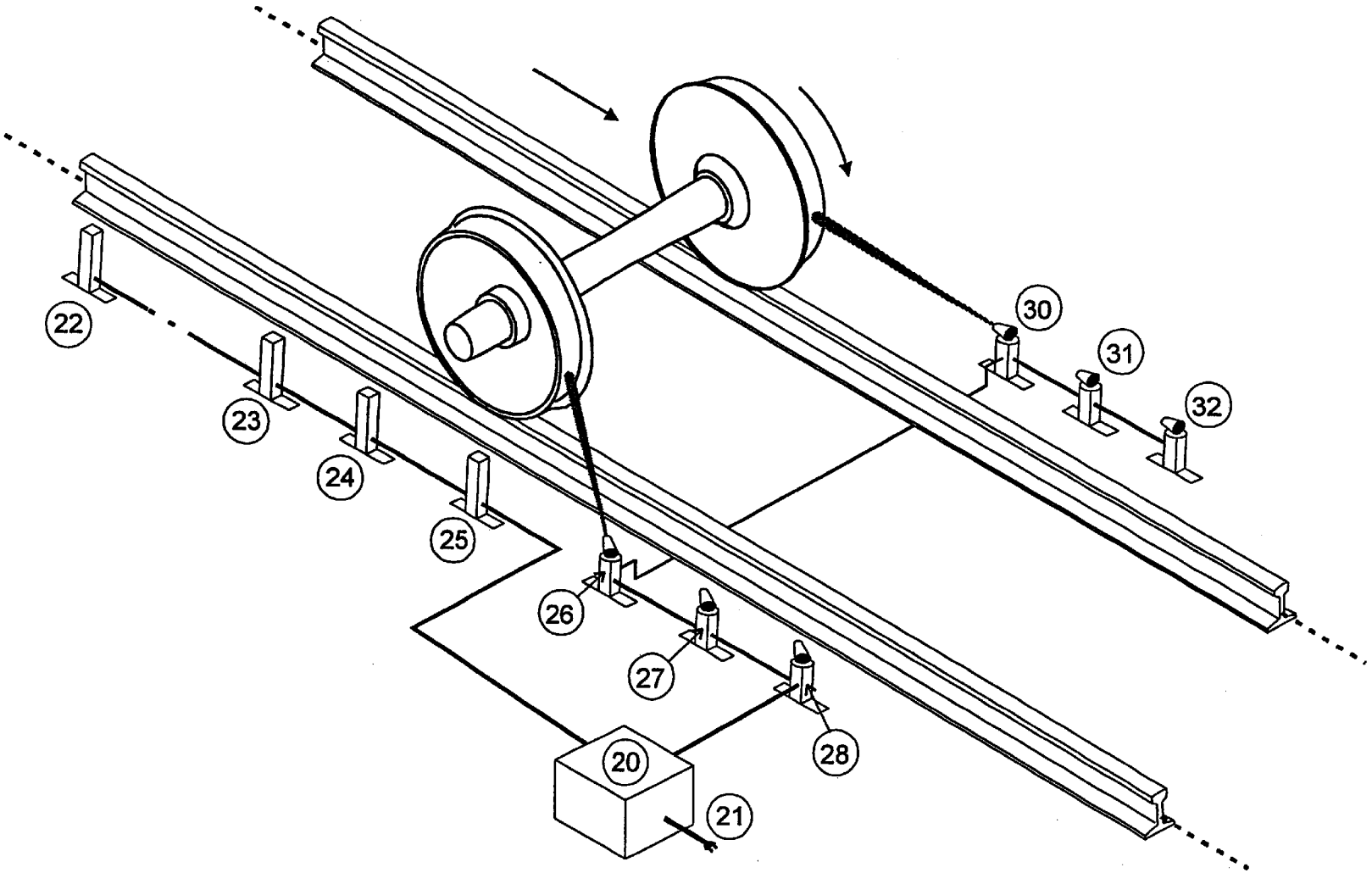
FIG. 5 is a schematic perspective view of an alternate embodiment of the wayside lubricator, showing a multiple nozzle arrangement.

The arrangements developed to apply the FM can vary. One can use a single nozzle for each rail or multiple sensors to trigger multiple nozzles which can be done with individual sensors or built in logic in the controller. FIG. 5 shows a multi-nozzle 26, 27, 28, 30, 31, 32 arrangement lubricator in which there are three sets of nozzles on each side corresponding to each rail which are triggered by three separate sensors 22, 23, 24, 25. The sensor signals are received by the controller box 38 contained in box 20. These signals then generate an output from the controller box 38 to trigger the solenoids in the nozzle holders 26, 27, 28, 30, 31, 32 and the jet sprays on the approaching wheel sets are made. To illustrate the use of a compressed air tank for providing the pressurized FM, this figure shows a tank containing the FM 41 and a compressor 42 with a pressure regulator 43, providing the needed pressure. When the wheel approaches the sensor 23, the nozzles at position 26, 30 apply the FM and when the wheel approaches sensor 24, the nozzles at position 27, 31 apply the FM and so on. The nozzles on both rails can be turned on simultaneously or selectively depending on the utilization on the curve, as the railroad needs. By way of example only, a solenoid valve has been used that takes about 5–6 milliseconds to open and about 4 milliseconds to close. A valve open time of a few milliseconds followed by a delay of about 5–10 millisecond followed by a second valve open time has been found adquate to apply two shots of FM to the wheel.

The duration and frequency of FM application shots may be based on train or car speed, train length and degree of curvature of the track. The duration may be corrected for the viscosity change of the lubricant with temperature such that the amount delivered to the wheel remains nearly the same, based on experimental measurements and lube temperature measurements in the box on the wayside. The microprocessor calculates the amount of FM applied to the wheels. More FM is applied for sharper curves and less (a shorter shot duration) for higher speed trains.

While a preferred form of the invention has been shown and described, it will be realized that alterations and modifications may be made thereto without departing from the scope of the following claims.

What is claimed is:

1. A wayside wheel lubricator for lubricating railroad car wheels rolling on track, each car wheel having a wheel tread and a flange, comprising:

a friction modifier supply and pressurizing means connected thereto, adapted for mounting on the wayside adjacent the track;

at least one sensor adapted for mounting on the wayside adjacent the track for sensing a car wheel;

at least one spray nozzle adapted for mounting on the wayside adjacent the track in fluid communication with the pressurizing means and aimed to spray friction modifier into a target zone, the target zone being defined by an area above the rail through which both the tread and flange of a wheel will pass and which is sized such that when both a wheel tread and flange are in the target zone no other part of the wheel is in the target zone; and a control unit responsive to the sensor for causing the release of friction modifier from the nozzle such that the friction modifier will be in the target zone when at least one of a wheel tread and a flange of a car wheel is in the target zone, the entire area of the target zone being wetted with the friction modifier when the friction modifier is released from the nozzle by the control unit.

2. The lubricator of claim 1 wherein there is at least one spray nozzle mounted adjacent each side of the track.

3. The lubricator of claim 1 wherein the sensor triggers the application of friction modifier for a defined duration of time.

4. The lubricator of claim 1 wherein the control unit triggers one or more individual shots of friction modifier on a single wheel.

5. The lubricator of claim 1 wherein the control unit includes a solenoid valve.

6. The lubricator of claim 1 wherein the pressurizing means comprises a pump.

7. The lubricator of claim 1 wherein the pressurizing means comprises an air compressor connected to the lubricant supply and a pressure regulator for maintaining the air pressure in the lubricant supply at a desired level.

8. A method of lubricating railroad car wheels rolling on track, each car wheel having a wheel tread and a flange, comprising:

mounting a friction modifier supply and pressurizing means connected thereto on the wayside adjacent the track;

mounting at least one sensor on the wayside adjacent the track for sensing a car wheel;

mounting at least one spray nozzle on the wayside adjacent the track in fluid communication with the pressurizing means and aiming the spray nozzle to spray friction modifier into a target zone, the target zone being defined by an area above the rail through which both the tread and flange of a wheel will pass and which is sized such that when both a wheel tread and flange are in the target zone no other part of the wheel is in the target zone; and connecting a control unit to the sensor and the pressurizing means for causing the release of friction modifier from the nozzle such that the friction modifier will be in the target zone when at least one of a wheel tread and a flange of a car wheel is in the target zone, the entire area of the target zone being wetted with the friction modifier when the friction modifier is released from the nozzle by the control unit.

9. The method of claim 8 further comprising the steps of detecting locomotive wheels and bypassing lubrication of locomotive wheels.

10. The method of claim 9 further comprising the step of turning on lubrication spray of car wheels after passage of locomotive wheels.

11. The method of claim 8 further comprising the step of activating the pressurizing system upon detection of the approach of a car wheel.

12. The method of claim 8 further comprising the step of calculating in the control unit the duration and frequency of friction modifier application based on car speed and degree of curvature.

13. The method of claim 8 further comprising the step of applying one or more shots of friction modifier on a single wheel set.

* * * * *

UNITED STATES PATENT AND TRADEMARK OFFICE

CERTIFICATE OF CORRECTION

PATENT NO. : 6,585,085 B1
DATED : July 1, 2003
INVENTOR(S) : Sudhir Kumar

It is certified that error appears in the above-identified patent and that said Letters Patent is hereby corrected as shown below:

Column 5,
Lines 45-53, please delete the following text: "The sensor signals are received by the controller box 38 contained in box 20. These signals then generate an output from the controller box 38 to trigger the solenoids in the nozzle holders 26, 27, 28, 30, 31, 32 and the jet sprays on the approaching wheel sets are made. To illustrate the use of a compressed air tank for providing the pressurized FM, this figure shows a tank containing the FM 41 and a compressor 42 with a pressure regulator 43, providing the needed pressure."
Line 45, after "25." please add the following text:
-- The sensor signal is received by the controller box 20 which turns the pump on and when the wheel approaches the sensor 23, a solenoid valve is opened to cause a spray of FM to be applied by the nozzle 26. --

Signed and Sealed this

Twenty-first Day of October, 2003

JAMES E. ROGAN
*Director of the United States Patent and Trademark Office*